US012778247B2

(12) United States Patent
Heim

(10) Patent No.: US 12,778,247 B2
(45) Date of Patent: Nov. 3, 2026

(54) FOLDING STICK

(71) Applicant: LEKISPORT AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 271 days.

(21) Appl. No.: 18/833,274

(22) PCT Filed: Jan. 17, 2023

(86) PCT No.: PCT/EP2023/050932
§ 371 (c)(1),
(2) Date: Jul. 25, 2024

(87) PCT Pub. No.: WO2023/147992
PCT Pub. Date: Aug. 10, 2023

(65) Prior Publication Data

US 2025/0098829 A1 Mar. 27, 2025

(30) Foreign Application Priority Data

Feb. 1, 2022 (CH) ..... 000094/2022

(51) Int. Cl.
*A45B 9/00* (2006.01)
*A63C 11/22* (2006.01)

(52) U.S. Cl.
CPC ..... *A45B 9/00* (2013.01); *A45B 2009/007* (2013.01); *A45B 2200/055* (2013.01); *A63C 11/227* (2013.01)

(58) Field of Classification Search
CPC ..... A45B 2009/005; A45B 2009/007; A45B 9/00
See application file for complete search history.

(56) References Cited

U.S. PATENT DOCUMENTS 8,950,415 B1 * 2/2015 Spletzer ..... A61H 3/02 135/74
9,609,925 B2 4/2017 Lenhart
(Continued)

FOREIGN PATENT DOCUMENTS

DE 694 01 765 T2 10/1997
DE 297 06 849 U1 9/1998
(Continued)

OTHER PUBLICATIONS

International Search Report for International Application No. PCT/EP2023/050932 dated Apr. 5, 2023.

*Primary Examiner* — Noah C. Hawk
(74) *Attorney, Agent, or Firm* — Sughrue Mion, PLLC

(57) ABSTRACT

Folding stick having at least three tubular portions which assembled are interconnected by plug-in connections, and at least two tubular portions are interconnected by a pull cable in the folded state. The plug-in connections have, at one tubular portion, a guide pin provided with a central through-opening for the pull cable and is fastened in this tubular portion by a fastening portion and has a plug region axially opposite. The fastening portion and plug region have a through-opening for the pull cable. A closure plug is removably inserted into the plug region and has an axial slot through which the pull cable can be introduced into the axial through-opening in the radial direction. A tubular protective sheath is provided around the pull cable and is form-fittingly held in or on the closure plug.

26 Claims, 3 Drawing Sheets

(56) References Cited

U.S. PATENT DOCUMENTS

| | | | | |
|---|---|---|---|---|
| 9,974,366 | B2 * | 5/2018 | Heim | A63C 11/22 |
| 11,148,023 | B2 * | 10/2021 | Roiser | A63C 11/221 |

FOREIGN PATENT DOCUMENTS

| | | | | | |
|---|---|---|---|---|---|
| DE | 297 08 829 | U1 | | 10/1998 | |
| EP | 0 098 898 | A1 | | 1/1984 | |
| EP | 1 217 224 | A1 | | 6/2002 | |
| EP | 1 450 906 | | | 11/2003 | |
| GB | 2514414 | A | * | 11/2014 | A45F 5/1026 |
| WO | 2010/085905 | A1 | | 8/2010 | |
| WO | 2012/104424 | A1 | | 8/2012 | |
| WO | 2015/044012 | A1 | | 4/2015 | |
| WO | 2018/224417 | A1 | | 12/2018 | |
| WO | 2021/156220 | A1 | | 8/2021 | |

* cited by examiner

FOLDING STICK

This is a National Stage Application of International Application No. PCT/EP2023/050932 filed Jan. 17, 2023, claiming priority based on Swiss Patent Application No. 000094/2022 filed Feb. 1, 2022.

TECHNICAL FIELD

The present invention relates to the sector of sticks for hiking and Nordic walking but also, in the widest sense, for other types of sport, such as cross-country skiing or downhill skiing, mountaineering etc.

PRIOR ART

In particular, but not exclusively, stick designs of adjustable length are known from the hiking and Nordic walking sector. On the one hand, the adjustability can be used here to enable the length of the stick to be adjusted to requirements, but, on the other hand, it can also be used to reduce the stick to a packing size that is a small as possible, i.e. to make the length reducible to such an extent that the stick can be stowed in a rucksack or the like, for example. Such designs, in which what are referred to as inner tubes with a small diameter are supported movably in an outer tube with a somewhat larger diameter and in which the relative position of the tubular portions can be fixed by means of a locking mechanism, are known, for example, from DE 297 06 849 or, alternatively, also from DE 297 08 829 or EP 1 450 906.

When using such designs, it is imperative that the individual tubular portions have different diameters, and, in particular, to achieve the small packing size, it must furthermore be ensured that the tubes can in fact also be telescoped into one another as far as possible. It may thus happen that the stick is very thin, especially in the lower region, where typically the thinnest tube is arranged, and therefore does not have sufficient intrinsic stiffness for some applications. Moreover, the designs disclosed in the abovementioned documents are often not viewed very favorably by users since the relative position of the individual tubular stick portions must be secured by twisting these tubular stick portions relative to one another, for which purpose corresponding manually applied rotational forces are required. Alternative mechanisms, in which the relative fixing of the axial position of different movable tubular portions is not achieved by means of an internal locking mechanism are known, for example, from WO 2010/085905 or, alternatively, also from DE 694 01 765 or EP 1 217 224 and EP 098 898. However, these external structures are often not suitable for supporting more than two stick tubes movably one inside the other, as a result of which the resulting packing size is then also not sufficiently small.

There are what are referred to as folding sticks, e.g. those known from WO 2012/104424, and, in the case of these sticks, individual stick segments are connected by means of plug-in connections. The stick segments can then have substantially the same diameters, and the stick segments are connected to one another by means of a tension cable, such that, after assembly, the individual stick segments are connected rigidly to one another in the axial direction by putting this tension cable under tension. The problem with these designs is that the flexible tension cable must connect the individual stick segments to one another and pass through them. As a result, designs of this kind are not conducive to production and servicing and it is only with difficulty that they can be assembled according to different customer requirements.

An improvement in this respect is described by WO 2021/156220, namely a folding stick with four or five tubular portions, which are connected to one another in the assembled state by means of plug-in connections, and, in the folded state, at least two or three tubular portions are connected to one another only by means of a movable connecting element. In this case, the folding stick is characterized in that a respective conical closure plug with an axial through-opening is fitted releasably, e.g. screwed, into the plug region of the plug-in connections, closing off said region with respect to the following tubular portion, and wherein each of these conical closure plugs has an axial slot, through which the tension cable can be introduced in the radial direction into the through-opening.

SUMMARY OF THE INVENTION

It is problematic with folding sticks of this kind that the tension cable used there, by means of which the individual tubular portions, which are connected by means of a pure plug-in connection, are connected, may be damaged with intensive use, and this already becomes problematic when the surface of the tension cable is no longer smooth since the stick can then no longer be readily fixed or can only be fixed with a great expenditure of force.

One solution consists in providing a tension cable with a sheath over its entire length, but this solution is expensive, ecologically questionable and furthermore also difficult to assemble since it is either necessary to remove the corresponding sheath where the tension cable must be secured or to implement the securing process while taking into account the sheath, which is laborious and difficult.

The present invention follows a completely different, surprisingly simple and very efficient path. To be specific, a protective sheath is provided, but in each case only precisely in the region around the tension cable where it is required, i.e. around the region of the tension cable which is exposed and bent in the folded state. To achieve this, it must now be ensured that the protective sheath does not hinder the axial mobility of the tension cable since, otherwise, the stick cannot be fixed in the assembled position. On the other hand, however, it must be ensured that the protective sheath cannot be displaced in the stick since, otherwise, it could be displaced out of the region around the tension cable where it is required. Accordingly, the core concept of the present invention consists in providing the plug-in connections with means which allow simple assembly and make it possible to secure the protective sheath there in a manner which nevertheless allows repair and exchange over the long term.

More specifically, the folding stick according to the present invention is a folding stick comprising at least three tubular portions, wherein, in the assembled state of the folding stick, the tubular portions are interconnected by means of plug-in connections in a manner aligned along the stick axis, and, in the folded state, at least two, or at least three, tubular portions are interconnected only by means of a movable connecting element in the form of a tension cable. Here, in general, a stick handle is arranged on an uppermost tubular portion, and a stick tip is arranged on a lowermost tubular portion At least one of the plug-in connections is implemented by means of a locking system in the form of an external clamping mechanism and/or a form-fitting latching device. The locking system is secured on a first tubular portion, and a second tubular portion, which has an outside diameter smaller than or approximately equal to the inside diameter of the first tubular portion, and which is supported in such a way as to be intrinsically movable in the first tubular portion, can thus be fixed in the relative axial position by the locking system. In this case, at least one further plug-in connection is designed as a pure plug-in connection, in which tubular portions are fixed only in one axial direction in the assembled state. At least the tubular portions participating in the pure plug-in connections are interconnected by means of at least the tension cable, which is generally secured on the lowermost tubular portion and is secured on an upper or on the uppermost tubular portion and is arranged so as to run through the interior at least of the tubular portions participating in the pure plug-in connections.

The folding stick is now designed in such a way that it can be transferred from the folded state to the assembled state by plugging the further plug-in connection(s) together and then, with the locking system released, pulling the second tubular portion out of the first tubular portion until the tension cable is under tension, and fixing the locking system.

The at least one further plug-in connection is designed in such a way that, on one tubular portion, it has a guide plug, which is provided with an axially extending central through-opening for the tension cable, is fixed firmly in this tubular portion by means of a securing portion and, at the axially opposite end, has a plug region which, in the folded state, is exposed and can be inserted into the other tubular portion. Both the securing portion and the plug region have a through-opening for the tension cable.

A closure plug having an axial through-opening for the tension cable is fitted, preferably releasably, into the plug region, closing off said plug region with respect to the following tubular portion, and this closure plug has an axial slot, through which the tension cable can be introduced into the axial through-opening in the radial direction.

According to the invention, the design is now characterized in that, for at least one pure plug-in connection, a tubular protective sheath is provided around the tension cable and is held in a form-fitting manner in or on the closure plug. In this case, the inside diameter of the through-opening in the protective sheath for the tension cable is so large that the tension cable is provided in such a way as to slide in the protective sheath, i.e. the axial mobility of the tension cable is not substantially hindered by the protective sheath.

A first preferred embodiment of this design is characterized in that, in the assembled state, the free end of the protective sheath does not extend as far as the end of the following tubular portion into which the plug region is inserted, wherein it preferably extends up to at most two thirds into the length of the following tubular portion, in particular preferably up to at most half or a third into the following tubular portion. In other words, when there is a plurality of pure plug-in connections, there is then also a plurality of protective sheaths of this kind, there being one for each plug-in connection.

The protective sheath preferably has means for producing the form-fitting connection. These can be designed in such a way that the protective sheath has, at its end facing the closure plug, at least one radially outward-projecting, preferably partially or completely encircling, widened portion for form-fitting connection to the closure plug.

At least one depression or groove, preferably an encircling groove, into which a widened portion of this kind engages, can be provided in the axial through-opening of the closure plug, wherein the widened portion is preferably arranged at the end of the protective sheath that faces the closure plug.

This is preferably an encircling groove in the closure plug, the latter preferably being halved in the longitudinal direction, with a radial depth in the range of 0.5-3 mm, preferably 1-2 mm and/or an axial width in the range of 0.5-4 mm, preferably in the range of 1-3 mm, which is preferably designed as a rectangular-section groove or as a groove with a rounded cross-sectional contour.

According to another preferred embodiment, the widened portion has a radial length projecting beyond the cylindrical outer surface of the protective sheath in the range of 0.5-3 mm, preferably in the range of 1-2 mm.

According to another embodiment, the protective sheath preferably has two radial widened portions spaced apart in the axial direction, where the spacing between the facing radial surfaces preferably corresponds substantially to the axial length of the closure plug, with the result that these radial surfaces come into contact with radial closure surfaces of the closure plug. In this embodiment, the two widened portions as it were enclose the closure plug from both axial sides, thus providing the form-fitting connection.

That surface of the widened portion facing the following tubular portion that faces the following tubular portion is preferably designed as a conical widened portion, which widens from the cylindrical outer circumference to the maximum radial length of this widened portion.

According to another preferred embodiment, the protective sheath has an axial through-opening, the inside diameter of which is larger than the outside diameter of the tension cable, wherein the protective sheath preferably has an inside diameter in the range of 0.75-3 mm, preferably in the range of 1-2.5 mm, in particular in the range of 1.25-2 mm, and the tension cable has an outside diameter in the range of 0.3-2.5 mm, preferably in the range of 0.5-1 mm.

Typically, the protective sheath is made from a soft thermoplastic material, preferably produced in an extrusion process or injection molding process, and wherein the material is preferably PU or silicone or a plasticized thermoplastic PVC or cross-linked or uncross-linked thermoplastic elastomer, preferably selected from the following group: silicone, thermoplastic polyamide elastomer, thermoplastic copolyester elastomer, thermoplastic elastomer based on an olefin, thermoplastic styrene block copolymer, in particular SBS, SEBS, SEEPS or MBS, wherein the material of the protective sheath is preferably transparent or translucent, to enable the underlying tension cable to be seen. The sheath is preferably a PVC tube. The tension cable is preferably a flexible but low-stretch tension cable with a thickness in the range of 0.5-1.5 mm, e.g. made from braided UHMWPE fibers obtained by gel extrusion spinning, encapsulated or provided with a coating of thermoplastic.

The tension cable typically consists of a flexible, longitudinally tension-resistant and inelastic material.

The flexible but low-stretch tension cable is constructed, for example, from low-stretch synthetic fibers, e.g. ultra-high molecular weight polyethylene (UHMWPE or PE-UHMW or high-modulus polyethylene=HMPE), m- or p-aramid or the like, monofilament and/or braided and/or sheathed. Another possibility is an optionally sheathed wire cable. The tension cable preferably has a thickness of 0.25-6 mm, preferably 0.4-3 mm, particularly preferably 0.5-2 mm. To ensure the tensile strength of the tension cable, multifilaments, for example, consisting of a plurality of monofilaments arranged in parallel, made from ultra-high molecular weight polyethylene (UHMWPE or PE-UHMW or high-modulus polyethylene=HMPE), for example, are preferred, optionally encapsulated in a supporting material, or multi-filaments consisting of a plurality of braided monofilaments, made from ultra-high molecular weight polyethylene (UHMWPE or PE-UHMW or high-modulus polyethylene=HMPE), for example, optionally encapsulated individually and/or as a braid into a supporting material. Chain-like tension cables are also possible. The individual tubular portions with the two upper nested tubular portions are thus loosely connected in this position, this being advantageous for transport and preventing the individual parts from being lost.

The clamping mechanism can be secured on a first tubular portion, and a second tubular portion, which has an outside diameter smaller than or approximately equal to the inside diameter of the first tubular portion, and which is supported in such a way as to be intrinsically movable in the first tubular portion, can be fixed in the relative axial position by the external clamping mechanism. The form-fitting latching device can be implemented on a second tubular portion, wherein the second tubular portion has an outside diameter smaller than or approximately equal to the inside diameter of a first tubular portion and can be inserted into the first tubular portion and can be fixed in the relative axial position by the form-fitting latching device.

As a preferred option, a respective closure plug having an axial through-opening is screwed, pressed and/or latched releasably into the plug region, preferably by means of latching elements or a bayonet catch, closing off said plug region with respect to the following tubular portion.

The folding stick is, for example, a folding stick comprising at least four or at least five tubular portions, and, in the assembled state, at least three tubular portions are interconnected only by means of a movable connecting element and can be connected by means of the further plug-in connections, and a respective closure plug having an axial through-opening is fitted releasably, preferably screwed, into the plug region, closing off said plug region with respect to the following tubular portion, and each of these closure plugs has an axial slot, through which the tension cable can be introduced into the through-opening in the radial direction. Another preferred embodiment is characterized in that the two or three lowermost tubular portions are interconnected by means of said pure plug-in connections, and in that the following or uppermost of the three tubular portions has at its upper end a closure plug, and the tension cable is secured in this uppermost closure plug.

In addition, the proposed folding stick can be characterized in that there is, above the first tubular portion, a further tubular portion, into which the first tubular portion can be inserted and which can be fixed axially and preferably in an infinitely variable manner in various positions by means of an external clamping mechanism, and in that the first tubular portion is preferably connected to this further tubular portion by a further tension cable, with the result that, when the external clamping mechanism is released, the first tubular portion cannot be pulled out of the further tubular portion beyond a defined end position, wherein the further tension cable is preferably secured releasably on the upper end of the further tubular portion or on a handle secured thereon, preferably in a rotation-free manner, wherein the securing of the further tension cable can preferably be released, optionally after the removal of a cover of the handle, by freeing the securing of this further tension cable from the outside in a nondestructive manner, e.g. by means of a hook connection.

The closure plug is preferably of one-piece design.

As one alternative, the closure plug has an axial slot, which has a predetermined width but can preferably be expanded against a restoring force and through which the tension cable with the protective sheath can be introduced into the through-opening in the radial direction and can secure the protective sheath in a form-fitting manner on the closure plug.

As another alternative, however, the closure plug is designed to consist of two closure-plug halves. This is preferably designed as a flexible one-piece component consisting of two closure-plug halves, preferably connected via a film hinge, wherein the film hinge connects the closure-plug halves on only one side of the through-opening.

Furthermore, the present invention relates to a method for assembling or repairing a folding stick as described above, which is preferably characterized in that the method has at least one step in which the closure plug and the opening of the slot are expanded, the tension cable with the protective sheath fitted is inserted into the through-opening, and the closure plug is closed again and, in the process, the form-fitting connection between the closure plug and the protective sheath is established, and the closure plug is secured in the plug region, wherein, in the case of a plurality of pure plug-in connections, one protective sheath pe plug-in connection is preferably fitted around the same tension cable.

Further embodiments are laid down in the dependent claims.

BRIEF DESCRIPTION OF THE DRAWINGS

Preferred embodiments of the invention are described in the following with reference to the drawings, which are only for the purpose of illustrating the present preferred embodiments of the invention and not for the purpose of limiting the same. In the drawings.

DESCRIPTION OF PREFERRED EMBODIMENTS

Figure 1:
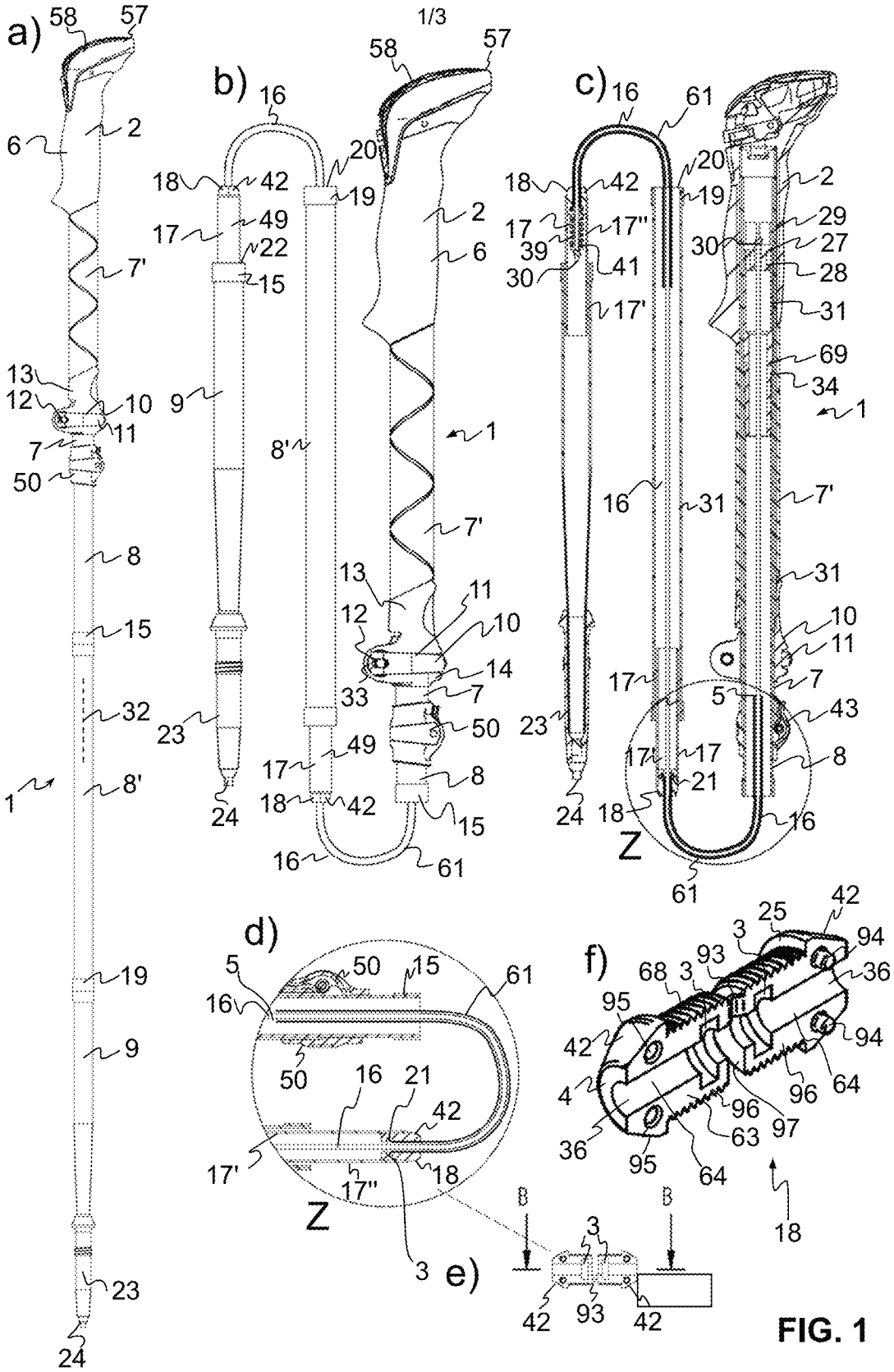
FIG. 1 shows views of a first exemplary embodiment, wherein *a*) shows a view of the stick with five tubular portions in the assembled state, *b*) shows a view of the stick in the folded state, wherein the lower two tubular portions are arranged loosely and in such a way that they are connected only via the tension cable and the three upper tubular portions are as far as possible nested one inside the other, and the uppermost two tubular portions are fixed in their axial position relative to one another by means of the external clamping mechanism; *d*) shows a detail as per Z in *c*), *e*) shows an opened-up view of the guide plug, and *f*) shows a perspective view of the opened-up guide plug.

FIG. 1 shows views of a first exemplary embodiment of a folding stick 1, wherein *a*) shows a view of the stick with five tubular portions in the assembled state, *b*) shows a view of the stick in the folded state, wherein the lower two tubular portions are arranged loosely and in such a way that they are connected only via the tension cable and the three upper tubular portions are as far as possible nested one inside the other, and the uppermost two tubular portions are fixed in their axial position relative to one another by means of the external clamping mechanism; *d*) shows a detail as per Z in *c*), *e*) shows an opened-up view of the guide plug, and *f*) shows a perspective view of the opened-up guide plug.

The folding stick 1 has five tubular portions, a lowermost tubular portion 9, on which a stick tip 23 with a tip element 24 at the lower end is secured, a middle tubular portion 8', which follows said portion in the upward direction, a further, second, tubular portion 8, which follows said middle portion, a first tubular portion 7 and an uppermost tubular portion 7', on the upper end of which the stick handle 2 is secured. The stick handle 2, which is preferably designed in the manner described in WO 2022/012964, the disclosure of which is incorporated herewith, typically has a handle head 57, which is closed off by a cap 58. This is a handle head on which the loop can be adjusted to different lengths by means of a corresponding mechanism. The stick handle 2 has a handle region 6 below the handle head 57.

The lowermost three tubular portions 8, 8' and 9 are interconnected by means of pure plug-in connections. In the connecting region, they each have the same diameter and, in the plug-in connections, there is in each case a guide plug 17 on the lower tubular portion. This is secured by means of a securing region 17' in the respective lower tubular portion and, above this, there is an actual plug region 49, the outside diameter of which corresponds substantially to the inside diameter of the next tubular portion following in the upward direction. In each case, the guide plug has a through-opening, via which a tension cable 16, by means of which at least the tubular portions connected via the pure plug-in connections are connected.

Here, the lowermost plug-in connection in the lowermost tubular portion 9 is designed in such a way that the tension cable 16 is secured in the guide plug, more specifically against the restoring action of a spiral spring 39, which is terminated by a guide element or terminal element 41, thus enabling the tension cable to be fixed at the bottom by means of a crimp or, as illustrated here, by means of a knot. The securing region 17' is typically bonded or pressed into the tubular portion and cannot readily be removed without destruction. The actual plug region 49 is formed integrally on this securing region. At the upper end of the plug region 49 there is a closure plug 18, which is fitted releasably into this plug region, typically by means of a screw connection, a bayonet connection or a clamping connection. The closure plug 18 is described in detail further below. A protective sheath 61 is provided on the closure plug 18 by means of a form-fitting connection, said sheath having a through-opening in which the tension cable 16 can slide substantially without friction. Here, the protective sheath is designed only as a short tubular portion, being made of PU or silicone for example, and extends just sufficiently far into the next tubular portion situated thereabove that, in the folded state, the entire exposed portion of the tension cable 16 which is not situated in the interior 31 of the following tube, and also the first interior region in the following tube, is covered. On the upper tubular portion there is a tube closure collar 19, the contact surface 20 of which comes into contact in the assembled state with a corresponding contact surface 22 either on a special element in the form of a tube closure collar 15 provided on the lower tube 9 or else with a flange of the closure plug 18. It is also possible for the two tubes to abut one another at this location.

The plug-in connection between the additional, middle, tubular portion 8' and the second tubular portion 8 is of analogous design, but here the tension cable passes freely through the plug-in connection. Here too, there is a closure plug 18, which is fitted releasably into the plug region 49 of the corresponding plug-in connection 17. Once again, a protective sheath 61 is provided for this plug-in connection, the length of the sheath being set in such a way that the free end 5 of the protective sheath 61 comes to lie in the interior 31 of the tube in all cases when the stick is folded up, as illustrated in figures b) and c). A tube closure collar 15 is provided at the bottom of the second tubular portion 8, and this tube is then inserted into the first tubular portion 7. The outside diameter of the second tubular portion 8 corresponds approximately to the inside diameter of the first tubular portion 7, and in order to put the cable 16 under tension when the tubular portions 8, 8' and 9 are assembled, the second tubular portion 8 is pulled out of the first tubular portion 7 to the maximum extent.

Provided at the lower end of the first tubular portion 7 is a latching device of the kind described in WO 2018/224417, for example, the disclosure of which in respect of this latching device is to be incorporated at this point. In this latching device there is a sprung rocker 43, which at its lower end has a radially extending edge that engages in an encircling groove 69 in a closure plug 34 when tube 8 is pulled out of tube 7 to the maximum extent.

The uppermost tubular portion 7' has the largest inside diameter, and the first tubular portion 7 is inserted into this uppermost tubular portion 7'. The relative axial position of these two tubular portions can be fixed by means of an external clamping mechanism 7. This is preferably a design of the kind described in WO 2015/044012, and the disclosure of this document in respect of this clamping mechanism is incorporated. In this clamping mechanism there is a clamping lever 11, which engages via a substantially axially extending spindle on a clamping spindle 12 extending perpendicularly to the stick axis 32, while an eccentric on the clamping lever rests on a washer provided in a projection in the slotted clamping region 14, below an encircling holding region 13.

The upper end of the tension cable 16 is secured in the first tubular portion 7, at the lower end of which the latching device 50 is provided, more specifically on an upper securing plug 27, which has a central through-opening 28 and, above the latter, a widened region 29, in which a knot 30 or a crimp is provided in order to secure the cable there.

The closure plug 18 consists of two closure-plug halves 96. The two halves are integrally connected by a film hinge 93. The conical closure-plug halves 96 are of substantially symmetrical design and separated by a central axial imaginary parting surface. When the two halves 96 are pivoted onto one another around the film hinge 93, the axial through-opening 64 is formed, and the slot 63 is provided by a spacing between the contact surfaces. When the conical closure plug 18 is screwed into the plug region 49 by means of the external thread 68, the slot 63 is closed on account of the contact between the contact surfaces. In order to ensure as precise as possible positioning of the two halves relative to one another, this being important especially because of the external threads 68, it is possible, as illustrated here, for positioning pegs 94 and corresponding positioning recesses 95 (in the form of blind holes), which may also be designed as a latching connection, to be provided in the contact surfaces. Other form-fitting and/or frictional connections are also possible, although they must be releasable.

In this case, the film hinge 93 is arranged on only one side of the axial end face 97, i.e. only on one side of the through-opening 64 formed in the assembled state, thus opening up the axial slot 63 and enabling the tension cable 16 together with the protective sheath 61 to be inserted.

An encircling groove 3 is now provided on the closure plug 18 in the axial through-opening 64. Engaging in this encircling groove 3 is a widened securing portion 21, which is provided on the lower end of the protective sheath 61. The protective sheath 61 is thereby secured with a form fit on the closure plug 18 and cannot slip, even if the tension cable 16 is displaced in the protective sheath 61 and, potentially, a certain friction occurs during this process. The protective sheath 61 thus remains at the position where it is needed.

Figure 2:
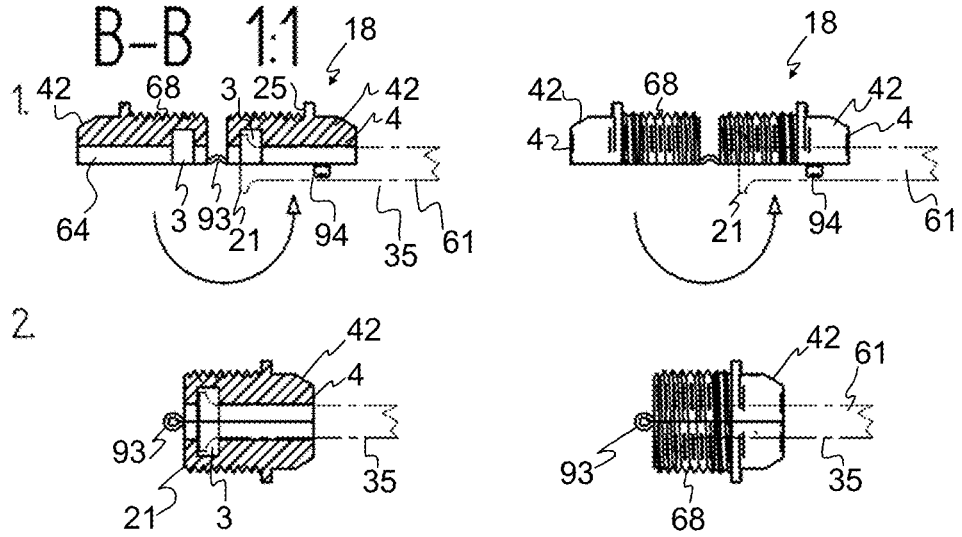
FIG. 2 shows the two essential steps of the assembly of the arrangement at the guide plug, with an axial section in a plane perpendicular to the plane of the paper of the illustration in FIG. 1*e*) being shown on the left, and the corresponding elevation being shown on the right, while the tension cable is not shown in either case.

FIG. 2 shows the essential steps of assembly, while the tension cable is not shown for the sake of better illustration. In the first, upper, step, the closure plug 18 is presented in the open form. The protective sheath 61 is threaded onto the tension cable 16, or it is already pre-installed on the tension cable and is moved to the required position, and the two of them are then inserted into the axial through-opening 64 in such a way that the widened securing portion 21 can come to rest in the groove 3, and the outer surface 35, or the central region 40 of the protective sheath 61, rests against the inner surface of the axial through-opening 64. That part of the closure plug 18 that is shown on the left in the figure is then folded over in accordance with the arrow shown at the top right, until the contact surfaces of the two halves rest on one another and the positioning pegs 94 engage in the positioning recesses 95. This closure plug 18, with the protective sheath 61 secured in a form-fitting manner thereon, can then be screwed into a corresponding internal thread in the plug region 49 by means of the external thread 68. Instead of an external thread of this kind, the split closure plug may also have two mutually opposite point-shaped raised portions which engage in two corresponding holes in the plug region, e.g. in the manner of a bayonet catch. However, the height of the point-shaped raised portions can be somewhat greater than the wall thickness of the plug region. The closure plug can then also be manufactured from a somewhat softer material to ensure that it is deformed elastically while being positioned in the plug region and snaps into the corresponding holes. The point-shaped raised portions thus additionally perform the function of play and noise damping.

Figure 3:
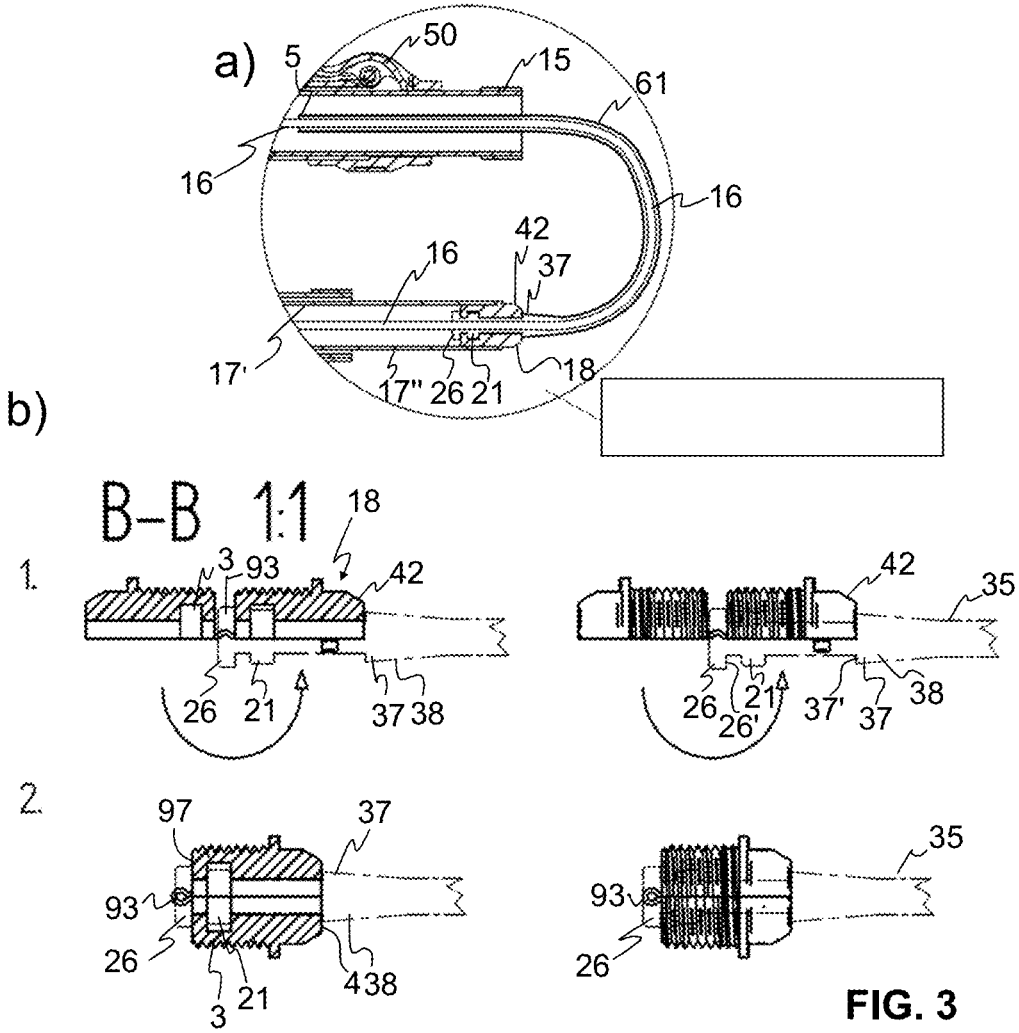
FIG. 3 shows the essential elements of a second exemplary embodiment, wherein *a*) shows a detail view as per Z in FIG. 1*c*), and *b*) shows the two essential steps of the assembly of the arrangement at the guide plug, with an axial section in a plane perpendicular to the plane of the paper of the illustration in FIG. 1*e*) being shown on the left, and the corresponding elevation being shown on the right, while the tension cable is not shown in either case.

FIG. 3 shows another exemplary embodiment, in which everything is basically of identical design to the first exemplary embodiment, the only difference being the configuration of the protective sheath. Here, this has two further radial widened portions in the region which is provided for securing on the closure plug. In addition to the already described widened portion 21, which is provided for engagement in the groove 3, there is a terminal widened edge portion 26 and a second widened edge portion 37 on the side facing the next tubular portion. The first widened edge portion 26 and the second widened edge portion 37 are spaced apart axially by an amount just sufficient to ensure that they enclose the axial length of the closure plug 18. In other words, the inner, radially extending stop surface 26' of the first widened edge portion 26 comes into stop contact with the surface 97 in the assembled state, and the inner, radially extending stop surface 37' of the second widened edge portion 37 comes into stop contact with the surface 4 of the closure plug in the assembled state. By means of this enclosure, a stable form-fitting connection between the closure plug 18 and the protective sheath 61 is ensured in addition to the engagement of the widened portion 21 in the groove 3.

Figure 4:
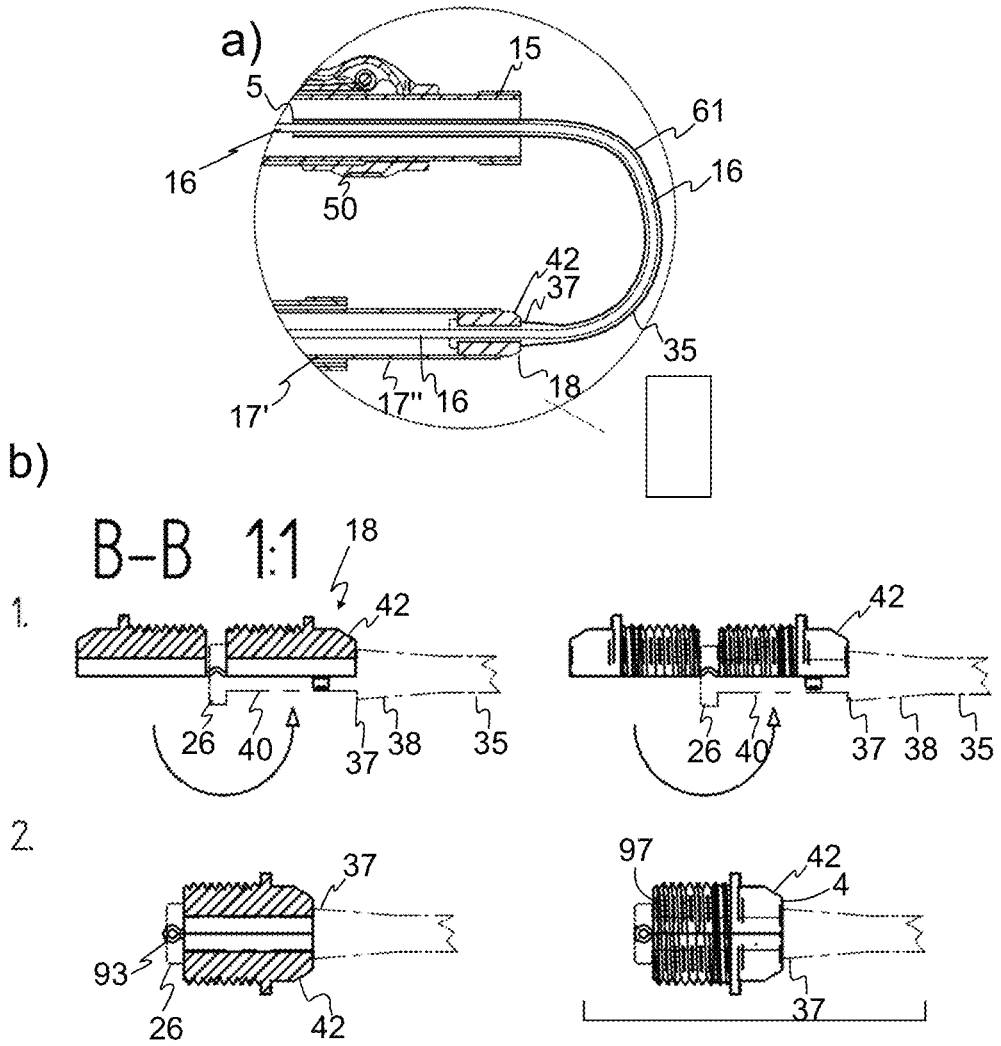
FIG. 4 shows the essential elements of a third exemplary embodiment, wherein *a*) shows a detail view as per Z in FIG. 1*c*), and *b*) shows the two essential steps of the assembly of the arrangement at the guide plug, with an axial section in a plane perpendicular to the plane of the paper of the illustration in FIG. 1*e*) being shown on the left, and the corresponding elevation being shown on the right, while the tension cable is not shown in either case.

FIG. 4 shows that, if the two widened edge portions 26 and 37 are provided, it may also be possible to dispense with the groove 3 and a corresponding widened securing portion 21. Here, the form-fitting connection between the closure plug 18 and the protective sheath 61 is achieved without special measures in the configuration of the closure plug 18, and the protective sheath 61 is secured in a form-fitting manner on the closure plug 18 by the enclosure of the closure plug 18 between the first widened edge portion 26 and the second widened edge portion 37. A conical widened region 38 ensures that there is a smooth transition between the cylindrical outer surface 35 of the protective sheath and the radially outermost region of the second widened edge portion 37.

LIST OF REFERENCE SIGNS

| | | | |
|---|---|---|---|
| 1 | Folding stick | 25 | Stop surface of 18 |
| 2 | Stick handle | 26 | First widened edge portion for stop contact with 97 |
| 3 | Encircling groove in 64 | 26' | Radially extending stop surface of 26 |
| 4 | End face of 18 | 27 | Retention element or upper securing plug for 16 |
| 5 | Free end of 61 | 28 | Central through-opening in 27 for 16 |
| 6 | Handle region of 2 | 29 | Widened region of 28 in the upper portion of 27 |
| 7 | First tubular portion | 30 | Knot on 16 |
| 7' | Uppermost tubular portion, additional tubular portion | 31 | Interior in the tube |
| 8 | Second tubular portion | 32 | Stick axis |
| 8' | Additional, middle, tubular portion | 33 | Washer |
| 9 | Lower tubular portion | 34 | Closure plug |
| 10 | External clamping mechanism | 35 | Outer surface of 61 |
| 11 | Clamping lever | 36 | Axial through-opening for 16 in 17 |
| 12 | Clamping spindle | 37 | Second widened edge portion for stop contact with 4 |
| 13 | Encircling holding region of 10 | 37' | Radially extending stop surface of 37 |
| 14 | Slotted clamping region of 10 | 38 | Conical widened region of 37 |
| 15 | Tube closure collar | 39 | Spiral spring |
| 16 | Tension cable | 40 | Central region of 61 |
| 17 | Guide plug or plug-in connection | 41 | Guide element or terminal element for 39 |
| 17' | Securing region of 17 in the respective lower tube with through-opening | 42 | Conically tapering region of 17/18 |
| 17" | Plug region with through-opening | 43 | Rocker of 50 |
| 18 | Closure plug | 49 | Plug region of 17 |
| 19 | Tube closure collar | 50 | Latching device |
| 20 | Contact surface of 19 with 22 | 57 | Handle head |
| 21 | Widened securing portion of 61 for engagement in 3 | 58 | Cap of 57 |
| 22 | Contact surface | 61 | Protective sheath |
| 23 | Stick tip | 63 | Axially extending slot in 18 |
| 24 | Tip element | 64 | Axial through-opening in 18 |
| 68 | External thread/encircling ribs of 18 | 93 | Film hinge |
| 69 | Encircling groove in 34 | 94 | Positioning peg |
| | | 95 | Positioning recesses |
| | | 96 | Conical closure-plug half |
| | | 97 | Axial end face |

The invention claimed is:

1. A folding stick comprising at least three tubular portions, wherein, in the assembled state of the folding stick, the tubular portions are interconnected by means of plug-in connections in a manner aligned along the stick axis, and, in the folded state, at least two, or at least three, tubular portions are interconnected only by means of a movable connecting element in the form of a tension cable, and wherein a stick handle is arranged on an uppermost tubular portion, and a stick tip is arranged on a lowermost tubular portion, wherein at least one of the plug-in connections is implemented by means of a locking system in the form of an external clamping mechanism or a form-fitting latching device, wherein the locking system is secured on a first tubular portion, and a second tubular portion, which has an outside diameter smaller than or approximately equal to the inside diameter of the first tubular portion, and which is supported in such a way as to be intrinsically movable in the first tubular portion, can be fixed in the relative axial position by the locking system, wherein at least one further plug-in connection is designed as a pure plug-in connection, in which tubular portions are fixed only in one axial direction in the assembled state, wherein at least the tubular portions participating in the pure plug-in connections are interconnected by means of at least the tension cable, which is secured on the lowermost tubular portion and is secured on an upper or on the uppermost tubular portion and is arranged so as to run through the interior at least of the tubular portions participating in the pure plug-in connections, and wherein the folding stick is designed in such a way that it can be transferred from the folded state to the assembled state by plugging the further plug-in connection(s) together and then, with the locking system released, pulling the second tubular portion out of the first tubular portion until the tension cable is under tension, and fixing the locking system, wherein the at least one further plug-in connection is designed in such a way that, on one tubular portion, it has a guide plug, which is provided with an axially extending central through-opening for the tension cable, is secured firmly in this tubular portion by means of a securing portion and, at the axially opposite end, has a plug region which, in the folded state, is exposed and can be inserted into the other tubular portion, wherein the securing portion and the plug region have a through-opening for the tension cable, wherein a closure plug having an axial through-opening is fitted into the plug region, closing off said plug region with respect to the following tubular portion, and wherein this closure plug has an axial slot, through which the tension cable can be introduced into the axial through-opening in the radial direction, wherein for at least one pure plug-in connection, a tubular protective sheath is provided around the tension cable and is held in a form-fitting manner in or on the closure plug, wherein the tension cable is provided in such a way as to slide in the protective sheath.

2. The folding stick as claimed in claim 1, wherein assembled state, the free end of the protective sheath does not extend as far as the end of the following tubular portion into which the plug region is inserted.

3. The folding stick as claimed in claim 1, wherein the protective sheath has, at its end facing the closure plug, at least one radially outward-projecting, widened portion for form-fitting connection to the closure plug.

4. The folding stick as claimed in claim 3, wherein the axial through-opening of the closure plug has at least one depression or groove, into which the widened portion engages.

5. The folding stick as claimed in claim 4, wherein the groove is an encircling groove with a depth in the range of 0.5-3 mm, preferably 1-2 mm and/or an axial width in the range of 0.5-4 mm, and in that the widened portion has a radial length in the range of 0.5-3 mm, by which it projects beyond the cylindrical outer surface of the protective sheath.

6. The folding stick as claimed in claim 4, wherein the groove is an encircling groove with a depth in the range of 1-2 mm and/or an axial width in the range of 1-3 mm, which is designed as a rectangular-section groove, and in that the widened portion has a radial length in the range of 1-2 mm, by which it projects beyond the cylindrical outer surface of the protective sheath.

7. The folding stick as claimed in claim 3, wherein the axial through-opening of the closure plug has at least one depression or an encircling groove, into which the widened portion engages, wherein the widened portion is arranged at the end of the protective sheath that faces the closure plug.

8. The folding stick as claimed in claim 1, wherein the protective sheath has two radial widened portions spaced apart in the axial direction, where the spacing between the facing radial surfaces corresponds substantially to the axial length of the closure plug, with the result that these radial surfaces come into contact with radial closure surfaces of the closure plug.

9. The folding stick as claimed in claim 8, wherein that surface of the widened portion facing the following tubular portion that faces the following tubular portion is designed as a conical widened portion, which widens from the cylindrical outer circumference to the maximum radial length of this widened portion.

10. The folding stick as claimed in claim 1, wherein the protective sheath has an axial through-opening, the inside diameter of which is larger than the outside diameter of the tension cable.

11. The folding stick as claimed in claim 1, wherein the protective sheath is made from a thermoplastic material, and/or in that the tension cable is made from a flexible material that is resistant to tension in the longitudinal direction and is inelastic.

12. The folding stick as claimed in claim 1, wherein the clamping mechanism is secured on a first tubular portion, and a second tubular portion, which has an outside diameter smaller than or approximately equal to the inside diameter of the first tubular portion, and which is supported in such a way as to be intrinsically movable in the first tubular portion, can be fixed in the relative axial position by the external clamping mechanism, and wherein the form-fitting latching device is implemented on a second tubular portion, wherein the second tubular portion has an outside diameter smaller than or approximately equal to the inside diameter of a first tubular portion and can be inserted into the first tubular portion and can be fixed in the relative axial position by the form-fitting latching device.

13. The folding stick as claimed in claim 1, wherein a respective closure plug-having an axial through-opening is screwed, pressed and/or latched releasably into the plug region, closing off said plug region with respect to the following tubular portion, and/or the folding stick is a folding stick comprising at least four or at least five tubular portions, and in that, in the assembled state, at least three tubular portions are interconnected only by means of a movable connecting element and can be connected by means of the further plug-in connections, and a respective closure plug having an axial through-opening is fitted releasably into the plug region, closing off said plug region with respect to the following tubular portion, and wherein each of these closure plugs has an axial slot, through which the tension cable can be introduced into the through-opening in the radial direction.

14. The folding stick as claimed in claim 1, wherein the two or three lowermost tubular portions are interconnected by means of said pure plug-in connections, and in that the following or uppermost of the three tubular portions has at its upper end a closure plug, and the tension cable is secured in this uppermost closure plug.

15. The folding stick as claimed in claim 1, wherein there is, above the first tubular portion, a further tubular portion, into which the first tubular portion can be inserted and which can be fixed axially in an infinitely variable manner in various positions by means of an external clamping mechanism.

16. The folding stick as claimed in claim 1, wherein the closure plug is of one-piece design, and either has an axial slot, which has a predetermined width and through which the tension cable with the protective sheath can be introduced into the through-opening in the radial direction and can secure the protective sheath in a form-fitting manner on the closure plug, or, as a flexible component, has two closure-plug halves.

17. The folding stick as claimed in claim 1, wherein said closure plug having an axial through-opening is releasably fitted into the plug region.

18. The folding stick as claimed in claim 1, wherein, in the assembled state, the free end of the protective sheath extends up to at most two thirds into the length of the following tubular portion, or up to at most half or a third into the following tubular portion.

19. The folding stick as claimed in claim 1, wherein the protective sheath has, at its end facing the closure plug, at least one radially outward-projecting, encircling, widened portion for form-fitting connection to the closure plug.

20. The folding stick as claimed in claim 1, wherein the protective sheath has an axial through-opening, the inside diameter of which is larger than the outside diameter of the tension cable, wherein the protective sheath has an inside diameter in the range of 0.75-3 mm, or in the range of 1-2.5 mm, or in the range of 1.25-2 mm, and the tension cable has an outside diameter in the range of 0.3-2.5 mm, or in the range of 0.5-1 mm.

21. The folding stick as claimed in claim 1, wherein the protective sheath is made from a thermoplastic material, produced in an extrusion process or injection molding process, and wherein the material is a cross-linked or uncross-linked thermoplastic elastomer selected from the following group: thermoplastic polyamide elastomer, thermoplastic copolyester elastomer, thermoplastic elastomer based on an olefin, thermoplastic styrene block copolymer, including SBS, SEBS, SEEPS or MBS, wherein the material can be transparent or translucent.

22. The folding stick as claimed in claim 1, wherein a respective closure plug having an axial through-opening is screwed, pressed and/or latched releasably into the plug region, by means of latching elements or a bayonet catch, closing off said plug region with respect to the following tubular portion, and/or the folding stick is a folding stick comprising at least four or at least five tubular portions, and in that, in the assembled state, at least three tubular portions are interconnected only by means of a movable connecting element and can be connected by means of the further plug-in connections, and a respective closure plug having an axial through-opening is fitted releasably screwed, into the plug region, closing off said plug region with respect to the following tubular portion, and wherein each of these closure plugs has an axial slot, through which the tension cable can be introduced into the through-opening in the radial direction.

23. The folding stick as claimed in claim 1, wherein there is, above the first tubular portion, a further tubular portion, into which the first tubular portion can be inserted and which can be fixed axially in an infinitely variable manner in various positions by means of an external clamping mechanism, and in that the first tubular portion is connected to this further tubular portion by a further tension cable, with the result that, when the external clamping mechanism is released, the first tubular portion cannot be pulled out of the further tubular portion, wherein the further tension cable is secured releasably on the upper end of the further tubular portion or on a handle secured thereon, in a rotation-free manner, wherein the securing of the further tension cable can be released, optionally after the removal of a cover of the handle, by freeing the securing of this further tension cable from the outside in a nondestructive manner, including by means of a hook connection.

24. The folding stick as claimed in claim 1, wherein the closure plug is of one-piece design, and either has an axial slot, which has a predetermined width but can be expanded against a restoring force and through which the tension cable with the protective sheath can be introduced into the through-opening in the radial direction and can secure the protective sheath in a form-fitting manner on the closure plug, or, as a flexible component, has two closure-plug halves, connected via a film hinge, wherein the film hinge connects the closure-plug halves on only one side of the through-opening.

25. A method for assembling or repairing a folding stick as claimed in claim 1, wherein the method has at least one step in which the closure plug is expanded by opening the slot, the tension cable with the protective sheath fitted is inserted into the through-opening, and the closure plug is closed again and, in the process, the form-fitting connection between the closure plug and the protective sheath is established, and the closure plug is secured in the plug region.

26. The method according to claim 25, wherein in the case of a plurality of pure plug-in connections, respective individual protective sheaths are fitted around the same tension cable.

* * * * *